US010465380B2

(12) United States Patent
Marden et al.

(10) Patent No.: US 10,465,380 B2
(45) Date of Patent: Nov. 5, 2019

(54) INSULATION DAM FOR BURIED DUCTS AND BURIED DUCT INSULATION DEPTH INDICATOR

(71) Applicant: Owens Corning Intellectual Capital, LLC, Toledo, OH (US)

(72) Inventors: Craig Marden, Shutesbury, MA (US); Mark H. Smith, Newark, OH (US)

(73) Assignee: Owens Corning Intellectual Capital, LLC, Toledo, OH (US)

( * ) Notice: Subject to any disclaimer, the term of this patent is extended or adjusted under 35 U.S.C. 154(b) by 0 days.

(21) Appl. No.: 15/708,211

(22) Filed: Sep. 19, 2017

(65) Prior Publication Data

US 2018/0080224 A1 Mar. 22, 2018

Related U.S. Application Data

(60) Provisional application No. 62/396,868, filed on Sep. 20, 2016.

(51) Int. Cl.
*E04B 1/76* (2006.01)
*F24F 13/02* (2006.01)

(52) U.S. Cl.
CPC ..... *E04B 1/7658* (2013.01); *F24F 13/0263* (2013.01)

(58) Field of Classification Search
CPC ..... E04B 1/7658; F24F 13/0263
USPC ..... 52/742.13
See application file for complete search history.

(56) References Cited

U.S. PATENT DOCUMENTS 2,629,140 A * 2/1953 MacMillan ..... E04B 1/80 52/406.1
2,700,633 A * 1/1955 Bovenkerk ..... E04B 1/803 156/82
2,989,790 A * 6/1961 Brown ..... E04B 1/7604 52/742.13
3,543,804 A * 12/1970 Ziegler ..... F16L 59/15 138/105
3,575,234 A * 4/1971 Diecknnann ..... F24F 3/044 165/49
3,641,724 A * 2/1972 Palmer ..... E04C 2/386 156/78
3,772,840 A * 11/1973 Hala ..... E04B 1/4185 52/302.3
3,915,477 A * 10/1975 Timmons ..... F16L 41/08 285/40
4,095,454 A * 6/1978 Fisher ..... G01M 99/002 374/43

(Continued)

FOREIGN PATENT DOCUMENTS

WO WO-8302491 A1 * 7/1983 ..... F16L 59/024

OTHER PUBLICATIONS

"Attics" Jul. 25, 2013 https://web.archive.org/web/20130725031509/http://www.bobandeva.com/rjc/attics.htm(Year: 2013).*

*Primary Examiner* — Patrick J Maestri
*Assistant Examiner* — Joseph J. Sadlon
(74) *Attorney, Agent, or Firm* — Calfee, Halter & Griswold LLP

(57) ABSTRACT

An insulation dam is provided that facilitates placement and retention of loosefill insulation over a duct. Additionally, a depth indicator is provided that facilitates placement of a proper depth of the loosefill insulation over the duct.

6 Claims, 7 Drawing Sheets

(56) References Cited

U.S. PATENT DOCUMENTS 4,134,242 A * 1/1979 Musz ..... E04F 21/085 252/62
4,272,935 A * 6/1981 Lukas ..... E04B 1/7604 118/24
4,275,541 A * 6/1981 Orals ..... E04B 5/10 411/412
4,290,247 A * 9/1981 Alderman ..... E04D 13/17 165/53
4,337,602 A * 7/1982 King ..... E06B 5/01 182/46
4,471,591 A * 9/1984 Jamison ..... E04B 1/10 264/46.4
4,829,738 A * 5/1989 Moss ..... E04B 1/7604 52/404.3
5,024,033 A * 6/1991 Anderson ..... E04B 1/10 52/404.2
5,197,251 A * 3/1993 Krysak ..... E04B 1/76 182/222
5,267,422 A * 12/1993 Crall, Jr. ..... B29C 44/58 206/524
5,365,716 A * 11/1994 Munson ..... E04B 1/7604 52/404.1
5,389,167 A * 2/1995 Sperber ..... B05B 7/0025 156/71
5,731,359 A * 3/1998 Moser ..... F16F 1/37 521/51
5,819,496 A * 10/1998 Sperber ..... E04B 1/7604 52/742.13
5,988,264 A * 11/1999 Goldsmith ..... F24F 5/0035 165/48.1
6,088,968 A * 7/2000 Williston, Jr. ..... E04F 21/12 241/101.742
6,112,490 A * 9/2000 Meyer ..... E04B 1/7604 52/317
6,128,884 A * 10/2000 Berdan, II ..... E04B 1/767 52/406.2
6,226,943 B1 * 5/2001 Grinshpun ..... E04B 1/80 52/309.4
6,604,993 B1 * 8/2003 Boniface ..... E04F 15/02458 165/168
6,858,280 B2 * 2/2005 Allen ..... E04B 1/803 428/69
6,935,379 B1 * 8/2005 Buchanan, Sr. ..... F16L 59/026 138/128
7,641,461 B2 * 1/2010 Khoshnevis ..... B29C 64/106 425/60
8,117,786 B1 * 2/2012 Tobbe ..... E04F 15/02458 165/168
8,438,789 B2 * 5/2013 Uhl ..... E06B 5/01 52/19
8,590,229 B2 * 11/2013 Taylor ..... E04F 11/062 182/46
8,850,752 B1 * 10/2014 Graboski ..... E04D 13/172 52/95
8,931,215 B1 * 1/2015 Cook ..... E04B 9/001 182/46
8,943,767 B2 * 2/2015 Lewis ..... E04D 13/0335 52/20
9,222,265 B2 * 12/2015 Richmond ..... E04F 11/062
9,309,663 B2 * 4/2016 Fay ..... E04B 1/62
9,587,397 B1 * 3/2017 McCary, Sr. ..... E04B 1/7608
9,822,526 B2 * 11/2017 Cook ..... E04B 1/4185 52/302.3
9,938,711 B2 * 4/2018 Grisolia ..... E04B 1/7604
9,951,969 B2 * 4/2018 Combs ..... F24F 13/082
10,234,168 B2 * 3/2019 Minter ..... F24F 13/0281
10,309,682 B2 * 6/2019 Combs ..... F24F 13/0263
2008/0202041 A1 * 8/2008 Dillon ..... E04D 13/152 52/95
2009/0044797 A1 * 2/2009 Klement ..... E04D 13/178 126/621

* cited by examiner

INSULATION DAM FOR BURIED DUCTS AND BURIED DUCT INSULATION DEPTH INDICATOR

CROSS REFERENCE TO RELATED APPLICATION

This application claims priority to and any benefit of U.S. Provisional Application No. 62/396,868, filed Sep. 20, 2016, the entire content of which is incorporated herein by reference

FIELD

The general inventive concepts relate to fiber insulation and, more particularly, to structure for facilitating application of loosefill insulation around existing ductwork.

BACKGROUND

Most buildings include some form of ductwork. For example, many buildings include HVAC ducts, such as in an attic of the building. It is known to cover these ducts with loosefill insulation, which is a type of insulation commonly used in attics. However, there is an unmet need for methods of and systems for easily and accurately insulating ducts (e.g., HVAC ducts) with loosefill insulation.

SUMMARY

The general inventive concepts relate to and contemplate methods of, systems for, and related structure for facilitating application of loosefill insulation (e.g., fiberglass loosefill insulation) around ducts.

In a first exemplary embodiment, an insulation dam (and a system of using such) is provided that facilitates placement and retention of loosefill insulation over a duct. Additionally, a method of applying loosefill insulation in an enclosed space including at least one duct is provided. The method comprises: erecting a first insulation dam on a first side of the duct; erecting a second insulation dam on a second side of the duct; and blowing loosefill insulation into the enclosed space, wherein a portion of the loosefill insulation is held in place between the first insulation dam and the second insulation dam, and wherein an average height of the loosefill insulation located between the first insulation dam and the second insulation dam is greater than an average height of the loosefill insulation not located between the first insulation dam and the second insulation dam.

In some embodiments, the first insulation dam comprises a plurality of first support members and a material that connects to each of the first support members. In some embodiments, each first support member is a rigid post that is spaced from the duct and extends vertically from a surface on which the duct rests. In some embodiments, the surface is a floor. In some embodiments, the material is one of a film, a fabric, and a net.

In some embodiments, the second insulation dam comprises a plurality of second support members and a material that connects to each of the second support members. In some embodiments, each second support member is a rigid post that is spaced from the duct and extends vertically from a surface on which the duct rests. In some embodiments, the surface is a floor. In some embodiments, the material is one of a film, a fabric, and a net.

In some embodiments, the first insulation dam and the second insulation dam are substantially aligned with one another, albeit on opposite sides of the duct.

In some embodiments, the first insulation dam and the second insulation dam each extend a length of the duct to be insulated.

In some embodiments, the enclosed space is an attic.

In some embodiments, the duct is a flexible duct.

In a second exemplary embodiment, a depth indicator (and a system of using such) is provided that facilitates placement of a proper depth of loosefill insulation over a duct. Additionally, a method of applying loosefill insulation in an enclosed space including at least one duct is provided. The method comprises: mounting a depth indicator on a portion of the duct, said depth indicator including indicia thereon; blowing loosefill insulation into the enclosed space so that the portion of the duct is covered by the loosefill insulation; and using the indicia on the depth indicator to determine when a sufficient amount of the loosefill insulation is situated above the portion of the duct.

In some embodiments, the depth indicator comprises a base and vertical member extending from the base. In some embodiments, the base includes an adhesive for attaching the depth indicator to the duct. In some embodiments, a first portion of the vertical member has a first color and a second portion of the vertical member has a second color, wherein the indicia comprises the transition from the first color to the second color. In some embodiments, the vertical member is centered on and extends perpendicular to an outer surface of the duct. In some embodiments, the vertical member is made of foam.

In some embodiments, the enclosed space is an attic.

In some embodiments, the duct is a flexible duct.

Numerous other aspects, advantages, and/or features of the general inventive concepts will become more readily apparent from the following detailed description of exemplary embodiments, from the claims, and from the accompanying drawings being submitted herewith.

BRIEF DESCRIPTION OF THE DRAWINGS

The general inventive concepts, as well as embodiments and advantages thereof, are described below in greater detail, by way of example, with reference to the drawings in which.

DETAILED DESCRIPTION

Figure 1:
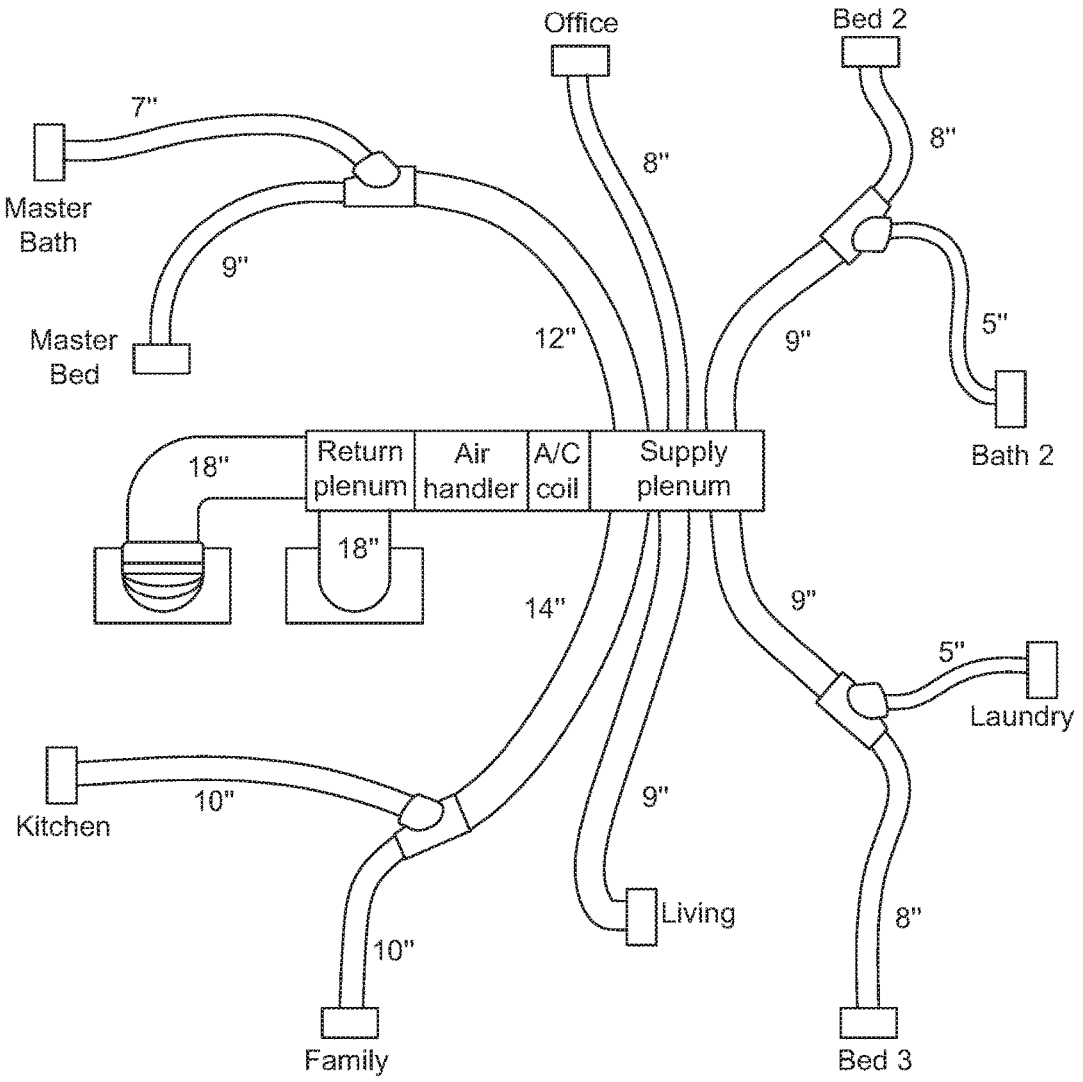
FIG. 1 is a diagram showing an HVAC system and its associated ductwork for a home, according to one exemplary embodiment.

While the general inventive concepts are susceptible of embodiment in many different forms, there are shown in the drawings, and will be described herein in detail, specific embodiments thereof with the understanding that the present disclosure is to be considered as an exemplification of the principles of the general inventive concepts. Accordingly, the general inventive concepts are not intended to be limited to the specific embodiments illustrated herein.

Burying or otherwise covering HVAC ducts, such as those commonly found in an unconditioned attic, with a quantity of loosefill insulation can significantly improve the energy performance of the HVAC system. An exemplary HVAC system and its associated ductwork for a home is shown in FIG. 1. In some exemplary embodiments, the loosefill insulation is fiberglass loosefill insulation.

Figure 2:
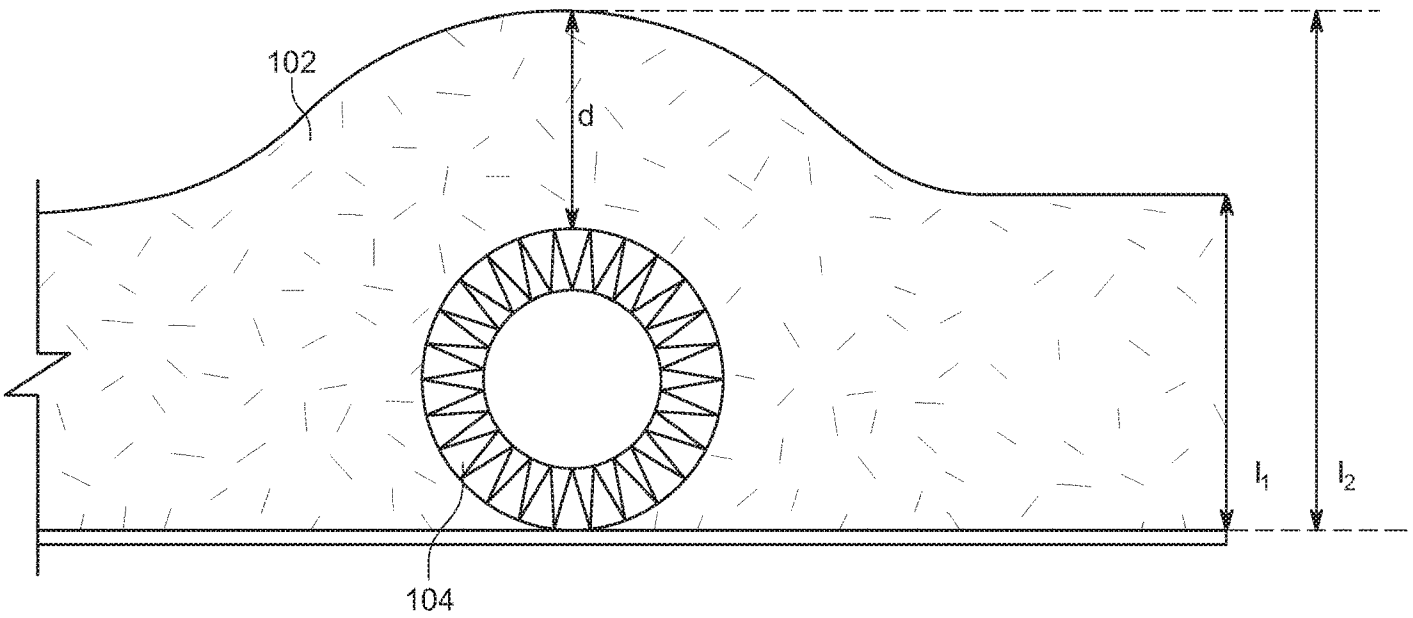
FIG. 2 is a cross-sectional view of a duct covered by loosefill insulation, according to one exemplary embodiment.

In general, the loosefill insulation must be mounded over the ducts to a level $l_2$ that exceeds the standard attic insulation level $l_1$, in order to achieve the aforementioned energy benefits. An exemplary duct covered by a bed of loosefill insulation extending above the standard attic insulation level $l_1$ is shown in FIG. 2.

Given its free-flowing nature, getting the loosefill insulation to cover the duct and stay there, so as to form a mound of sufficient height, is not an easy task. Accordingly, in a first exemplary embodiment, an insulation dam 100 is provided that facilitates placement and retention of loosefill insulation 102 over a duct 104.

Figure 3A:
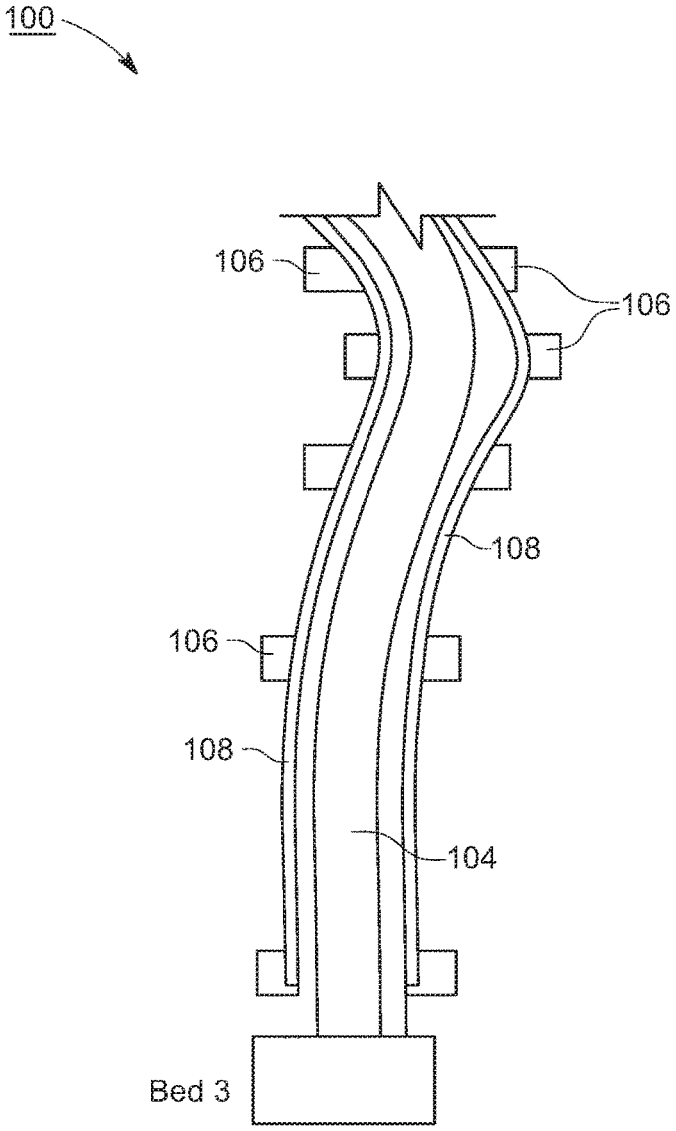
FIG. 3A is a plan view of an insulation dam formed around a duct to be insulated, according to one exemplary embodiment.

The insulation dam 100 is created on each side of the duct 104 to be covered and extends along a length of the duct 104. For example, vertical posts (e.g., stakes 106) are situated along the length of the duct 104 to be insulated. This can be seen in FIG. 3A, where five (5) pairs of stakes 106 are situated on each side of the duct 104 to be insulated. The stakes 106 can be anchored in any suitable manner, such as by attachment to the attic/roof framing so as to follow the path of the duct or existing roof framing members (e.g., truss webs).

Figure 3B:
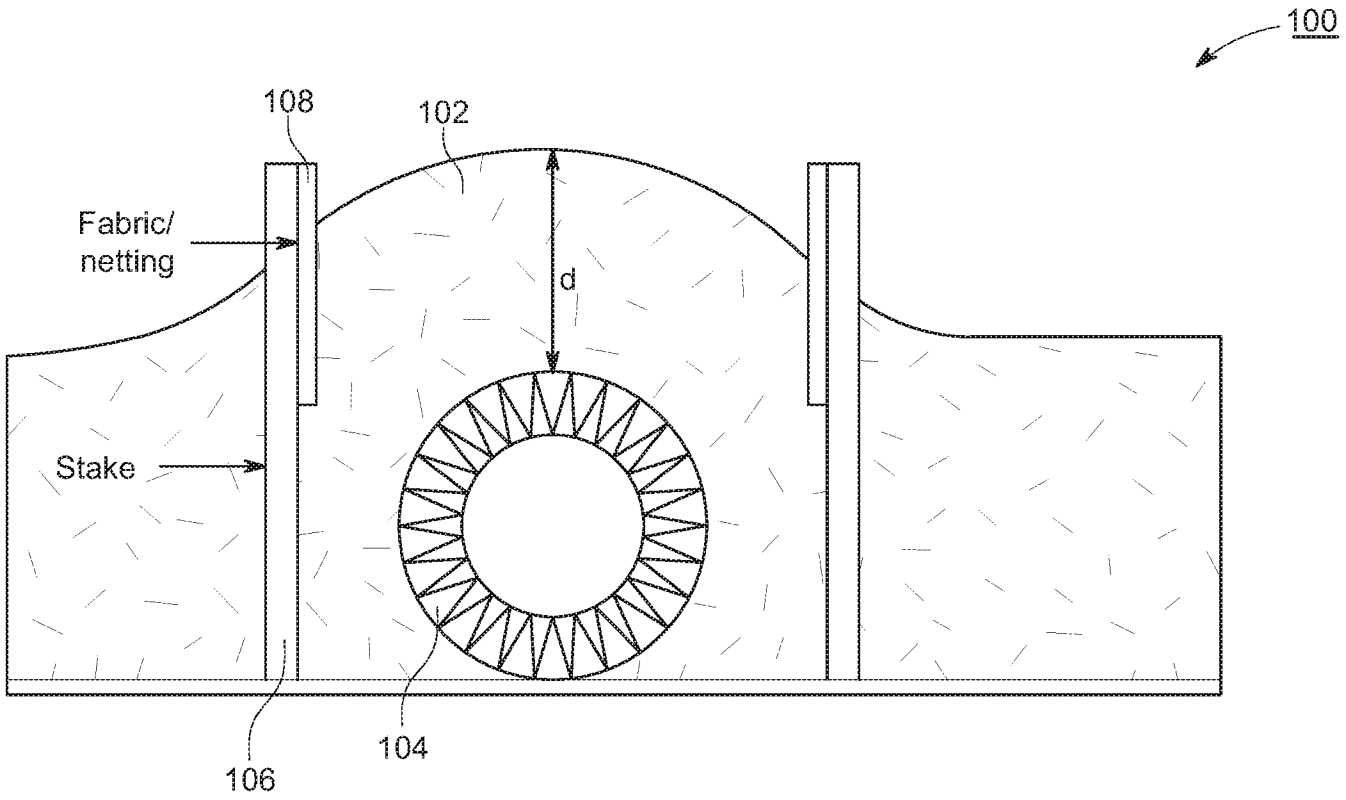
FIG. 3B is a cross-sectional view of an insulation dam formed around a duct to be insulated, according to one exemplary embodiment.

The stakes 106 support a material (e.g., from a rollable sheet of material) on each side of the duct, thereby forming the "walls" 108 of the insulation dam 100 on each side of the duct 104. This can be seen in FIGS. 3A and 3B. Any suitable material can be used to form the walls 108, such as fabric, netting, etc.

The walls 108 of the insulation dam 100 form a barrier on each side of the duct 104 that traps the loosefill insulation 102 being applied thereon, thereby facilitating creation of a mound of the loosefill insulation 102 having a desired height. Furthermore, because the mound of loosefill insulation 102 can be concentrated over the duct 104, via the insulation dam 100, application of excess loosefill insulation (i.e., waste) can be minimized.

The size (i.e., height) of the insulation dam 100 can be readily varied by changing the height of the stakes 106 and/or the walls 108. Likewise, a width of the insulation dam 100 can be varied by changing the distance the stakes 106 are placed relative to the duct 104 to be insulated. In this manner, a desired insulation profile can be readily tuned.

As noted above, in general, the loosefill insulation 102 must be mounded over the duct 104 to a level $l_2$ that exceeds the standard attic insulation level $l_1$, as shown in FIG. 2, in order to achieve performance benefits/energy savings. In other words, a height of the additional loosefill insulation 102 directly above the duct 104 is approximately equal to $(l_2-l_1)$. However, once application of the loosefill insulation 102 commences, the duct 104 quickly becomes submerged in the loosefill insulation 102 and cannot be seen. Consequently, it is not easy to accurately assess a depth of the loosefill insulation 102 that extends above the duct 104. Accordingly, in a second exemplary embodiment, a depth indicator 200 is provided that facilitates placement of a proper depth d of the loosefill insulation 102 over the duct 104.

Figure 4:
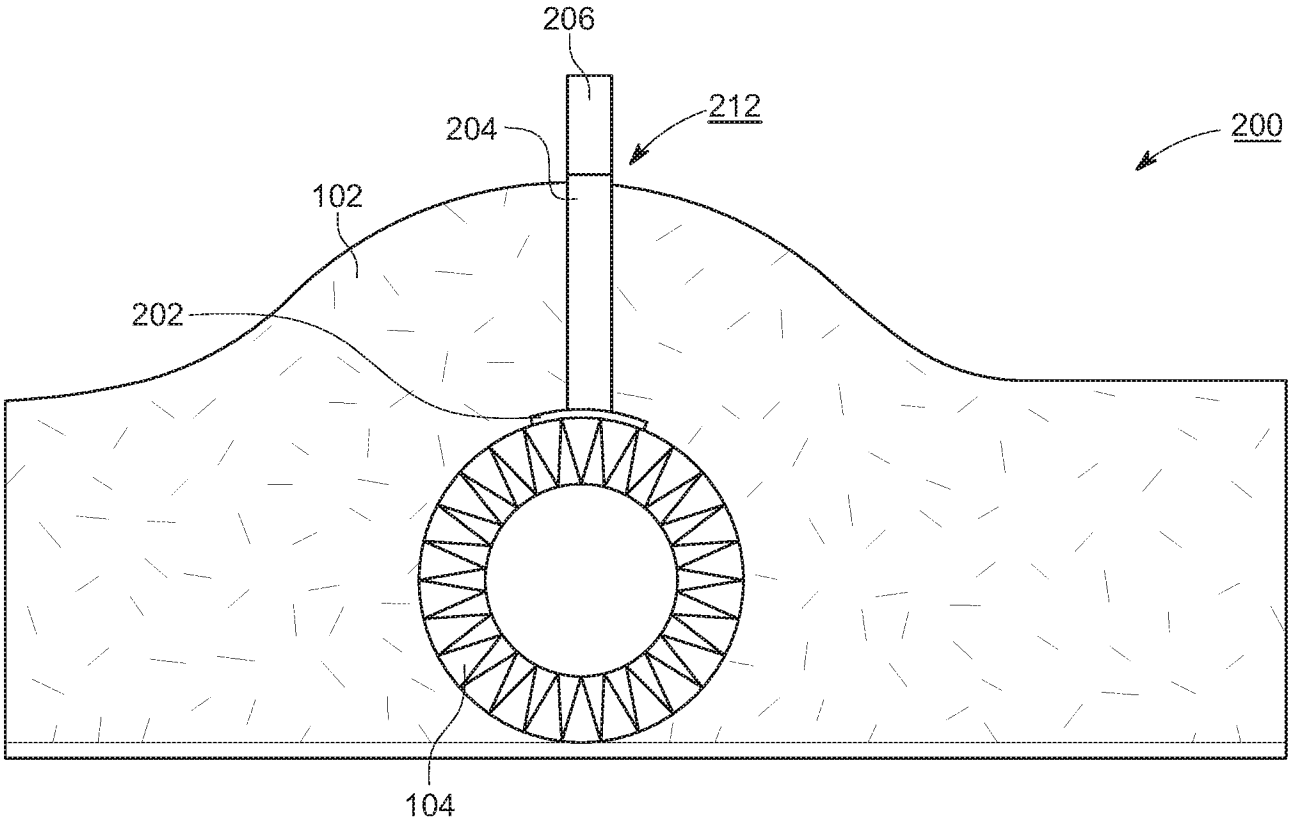
FIG. 4 is a cross-sectional view of a duct covered by loosefill insulation with a depth indicator mounted thereon, according to one exemplary embodiment.

The depth indicator 200, according to an exemplary embodiment, is a flag, marker, or the like that can be mounted on top of the duct 104 prior to blowing the loosefill insulation 102 thereon. The depth indicator 200 allows for easy locating of the ducts (e.g., the duct 104) within the loosefill insulation 102 and accurate assessment of the current depth of the loosefill insulation 102 over the duct 104. For example, as shown in FIG. 4, a duct 104 with a depth indicator 200 mounted thereon could be used to cover the duct 104 with a desired quantity of the loosefill insulation 102.

Figure 5:
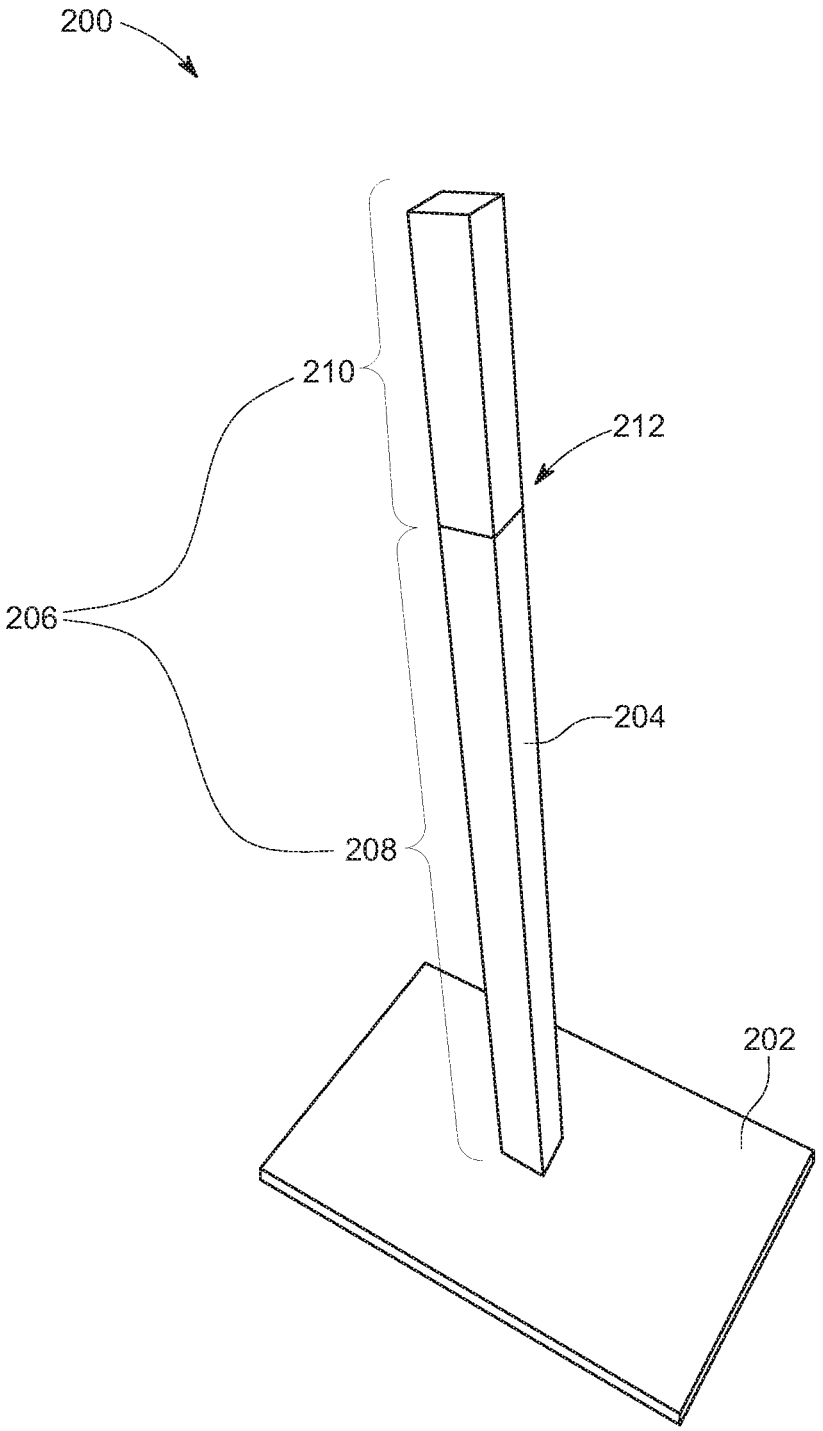
FIG. 5 is an image of a depth indicator, according to an exemplary embodiment.

A depth indicator 200, according to an exemplary embodiment, is shown in FIG. 5 prior to being mounted on a duct 104. The depth indicator 200 includes a base/saddle 202 for mounting the depth indicator 200 to the duct 104. The base/saddle 202 can be made of a semi-rigid material (e.g., cardboard). Any suitable means for mounting or otherwise attaching the base/saddle 202 to the duct 104 can be used. In one exemplary embodiment, the base/saddle 202 includes tape on opposite edges, at least a portion of each piece of tape being used to adhere the base/saddle 202 to the duct 104.

Extending from the base/saddle is a pin, nail, or the like (not shown) upon which a foam stick 204 is impaled. For example, the pin could be taped to the base/saddle. The foam stick 204 can have any desired dimensions (e.g., 1 inch×1 inch×a length suitable for the desired insulation depth). The foam stick 204 has indicia 206 thereon that facilitates placement of a proper depth of the loosefill insulation over the duct. In one exemplary embodiment, the indicia 206 on the foam stick 204 includes two visibly distinct colors (e.g., pink and black). The pink section 208 forms the lower part of the foam stick 204, while the black section 210 forms the upper part of the foam stick 204. In some exemplary embodiments, the foam stick 204 is formed of one of the two colors, with a relevant portion of the foam stick 204 being painted the other color. The pink section 208 should be immersed in the loosefill insulation 102 and the black section 210 should remain exposed. The demarcation 212 between the two colors is set to correspond to the proper fill depth d for the loosefill insulation 102, which can be easily, visibly tracked by the installer blowing the loosefill insulation 102. In this manner, as long as the installer sees any portion of the pink section 208 of the foam stick 204, the installer knows to keep applying the loosefill insulation 102 over the duct 104.

Figure 6:
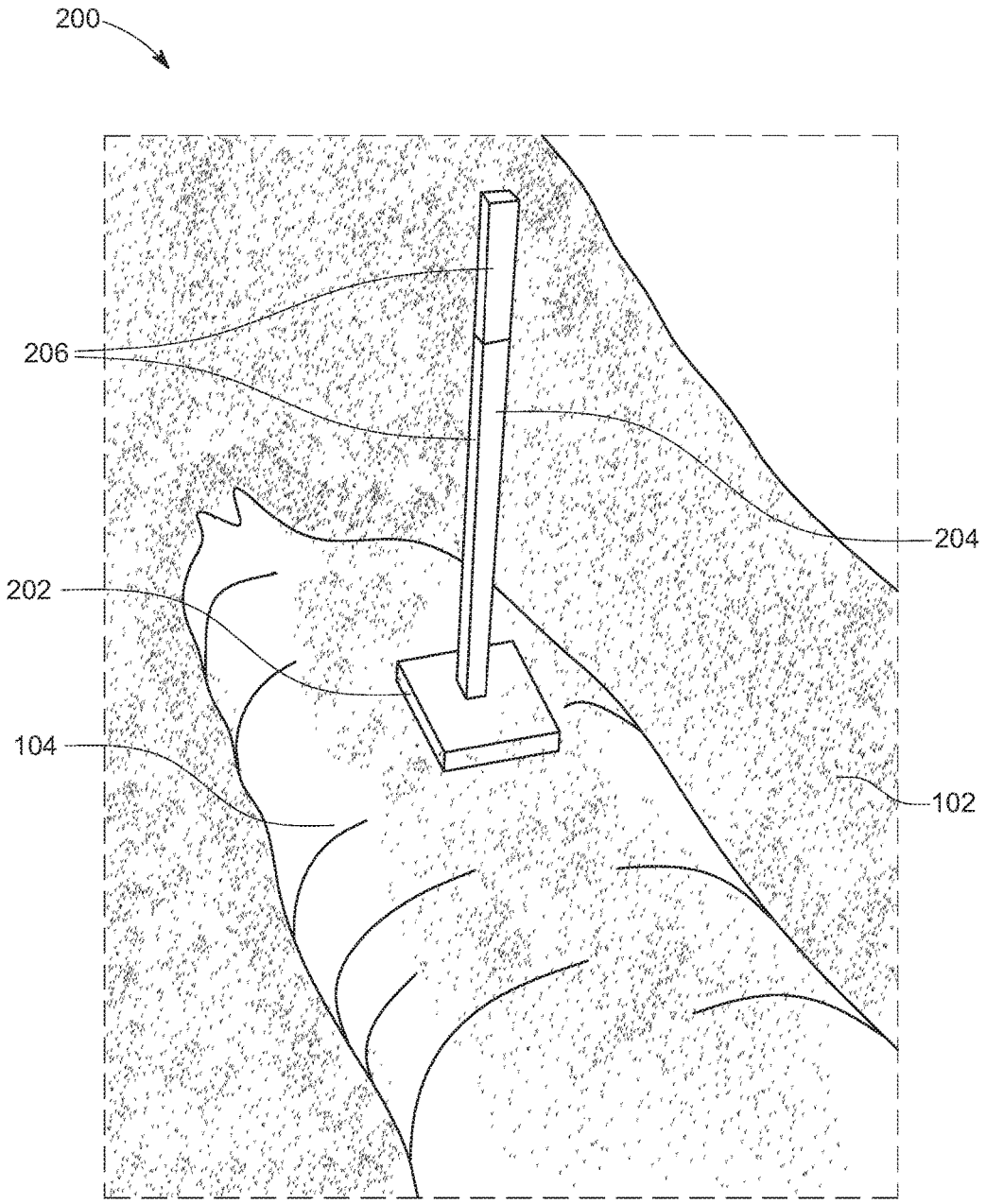
FIG. 6 is an image of the depth indicator of FIG. 5 mounted on a flexible duct to which application of loosefill insulation has begun.

FIG. 6 shows the depth indicator 200 of FIG. 5 mounted on a flexible duct to which application of loosefill insulation has begun.

It will be appreciated that the length of the foam stick 204 forming the depth indicator 200 (or application of the relevant indicia 206 thereon) may vary depending on the size of the duct and its associated R-value. Furthermore, other forms of the indicia 206 can be used without departing from the spirit and scope of the general inventive concepts. In general, any form of indicia can be used that allows an installer to readily identify when a sufficient level of loosefill insulation has been mounded above a duct to be insulated. For example, the indicia 206 might involve numbered lines (similar to a ruler) to indicate current fill depth.

The general inventive concepts relate to and contemplate methods of, systems for, and related structure for facilitating application of loosefill insulation around ducts. The related structure can include embodiments of the insulation dam and/or the depth indicator described herein. The methods of and/or system for facilitating application of loosefill insulation around ducts can use the insulation dam and/or the depth indicator described herein.

The scope of the general inventive concepts presented herein are not intended to be limited to the particular exemplary embodiments shown and described herein. From the disclosure given, those skilled in the art will not only understand the general inventive concepts and their attendant advantages, but will also find apparent various changes and modifications to the methods and systems disclosed. It is sought, therefore, to cover all such changes and modifications as fall within the spirit and scope of the general inventive concepts, as described and/or claimed herein, and any equivalents thereof.

The invention claimed is:

1. A method of applying loosefill insulation in an enclosed space including a duct, the method comprising the ordered steps of:

mounting a depth indicator on the duct, said depth indicator comprising a base and a vertical member extending from the base, wherein the base affixes the depth indicator to the duct, and wherein a first continuous length of the vertical member is a first color and a second continuous length of the vertical member is a second color;

blowing loosefill insulation into the enclosed space so that the loosefill insulation reaches a first height in the enclosed space adjacent to the duct and a second height in the enclosed space over the duct; and determining the loosefill insulation has reached the second height when the second color is no longer visible, wherein a total length of the vertical member is equal to a sum of the first length and the second length, and wherein at least one of the first length and the second length is equal to or greater than half of the total length.

2. The method of claim 1, wherein the base includes an adhesive for attaching the depth indicator to the duct.

3. The method of claim 1, wherein the vertical member is centered on and extends perpendicular to an outer surface of the duct.

4. The method of claim 1, wherein the vertical member is made of foam.

5. The method of claim 1, wherein the enclosed space is an attic.

6. The method of claim 1, wherein a width of the base is greater than a width of the vertical member.

* * * * *